United States Patent [19]

Hudson et al.

[11] Patent Number: 4,929,187

[45] Date of Patent: May 29, 1990

[54] LIGHT FIXTURE CONNECTOR

[76] Inventors: Trudy M. Hudson; Henry R. Hudson, both of 10819 63 Avenue, Edmonton, Alberta, Canada, T6H 1P9

[21] Appl. No.: 336,695

[22] Filed: Apr. 12, 1989

[30] Foreign Application Priority Data

Nov. 25, 1988 [CA] Canada ..... 584099

[51] Int. Cl.[5] ..... H01R 13/625

[52] U.S. Cl. ..... 439/334; 439/537

[58] Field of Search ..... 439/529–531, 439/537, 333, 334; 362/147, 404; 248/342, 343

[56] References Cited

U.S. PATENT DOCUMENTS 1,486,896 3/1924 Hubbell ..... 439/529
1,511,594 10/1924 DeLamar ..... 174/54
2,671,821 3/1954 Zientowski et al. ..... 174/54

FOREIGN PATENT DOCUMENTS 1040606 10/1978 Canada .
2401967 7/1974 Fed. Rep. of Germany .

*Primary Examiner*—Gary F. Paumen
*Attorney, Agent, or Firm*—Ratner & Prestia

[57] ABSTRACT

An electrical coupling device for detachably securing a fixture to an electrical outlet box comprises male and female interconnecting components. The fixture is connected to the male component where the male component is secured to the female component by rotating the male component. The male component has a plurality of catches. The male has a plurality of studs for insertion and engagement with the catches by way of rotational movement of the studs into the catches. The catches are spaced apart in a circular array at a first radius. The improvement comprises at least two spaced apart female resilient clips of electrically conductive metal. The clips are located in a circular pattern at a second radius on the female component. The male component has at least two spaced-apart contacts of electically conductive metal. The contacts are located in a circular pattern at the second radius. The male contacts are in register with the clips when the studs are in register with catches. Rotation of the male component to engage the studs with the catches simultaneously engages the contacts with the clips to depress the clip slightly to ensure electrical contact. The electrical coupling device is characterized by minimal protrusion into the electrical junction box; direct mounting by means of a simple one-step rotation; and applicability to a wide range of fixtures junction boxes; and direct mounting without the requirement of a junction box.

19 Claims, 7 Drawing Sheets

FIG.3.
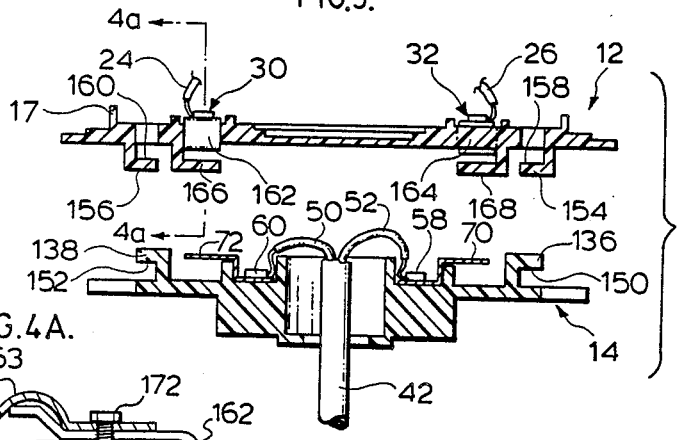
FIG.4A.
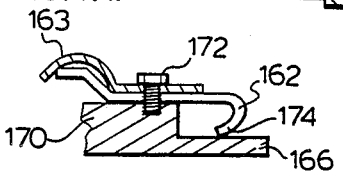
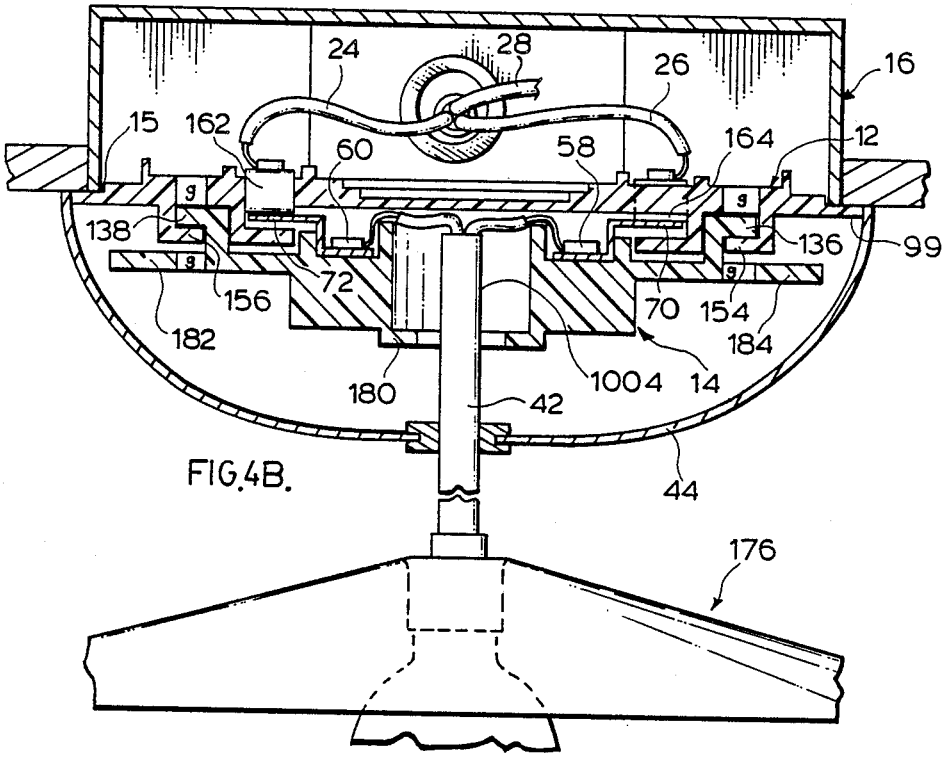
FIG.4B.

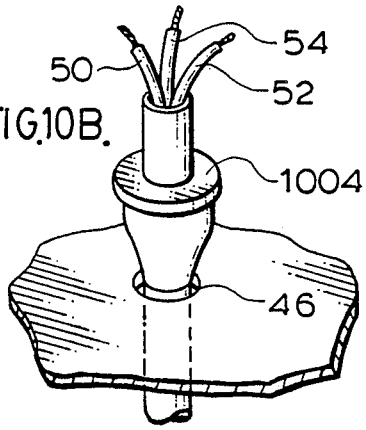
FIG.10B.
FIG.11.
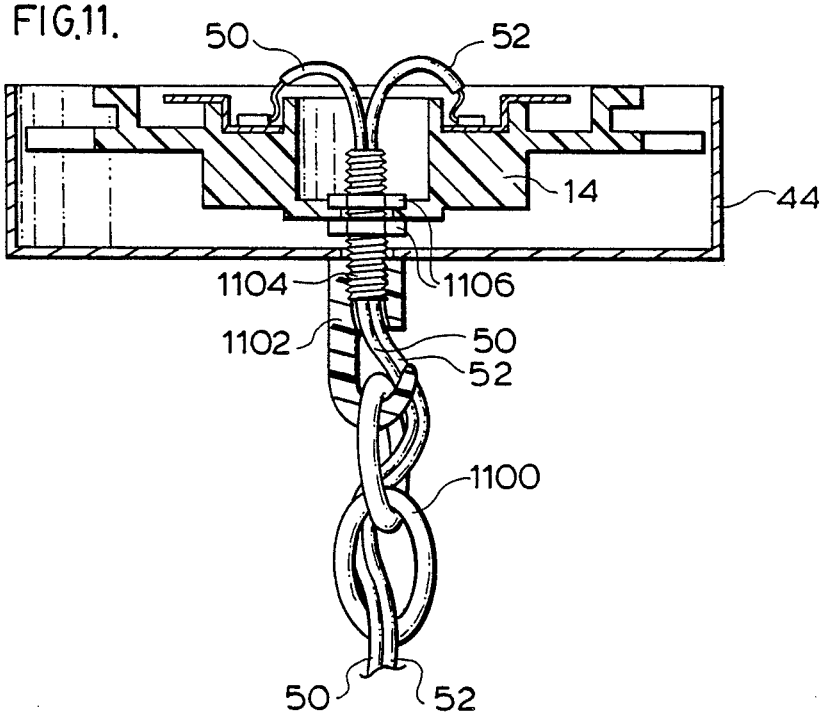

LIGHT FIXTURE CONNECTOR

FIELD OF THE INVENTION

This invention relates to coupling devices for electrical fixtures, such as connecting a lamp to a ceiling or wall outlet.

BACKGROUND OF THE INVENTION

It is appreciated that it is very awkward and potentially hazardous for the average person to wire or rewire electrical connections involving electrical fixtures, such as lamps, outlet plugs and the like. Normally, this sort of work is left to the skilled tradesman; however, there are many householders who for various reasons wish to make their own installations. It would therefore be expedient for both the skilled tradesman and the householder to have a simple hazard-free form of installing lamp fixtures and the like on wall and ceiling outlet boxes. This problem has been appreciated for some time and as a result many solutions have been posed as exemplified in the following patents.

A simple form of plug-in arrangement is disclosed in U.S. Pat. Nos. 1,486,896; 1,511,594 and 2,671,821. The wall or ceiling outlet box has provided in a sealed face thereof a standard type of plug outlet. The lamp to be secured to the outlet box has a base plate which is coupled in one form or another to the outlet box. Before such coupling is completed, the lamp fixture plug is simply plugged into the outlet plug of the electrical box. This type of arrangement reduces hazard in the average householder making connections and for the skilled workman provides an expedient form of connection. It is appreciated, of course, that the outlet box has to have been prewired by a competent individual.

All of the devices described in the aforementioned patents significantly protrude into the electrical outlet box (or wall or ceiling if there is no such box). This degree of protrusion into the electrical outlet box is in contravention of most electrical safety codes. Furthermore, all of the devices described in the prior art patents require two or more steps for detachment or mounting of a fixture within appropriate connector.

In addition, the prior art devices cannot be used universally for connecting a wide variety of fixtures. For example, the devices of U.S. Pat. Nos. 1,486,896 and 1,511,594 are designed specifically for wall mounting wherein the downward weight of the fixture is required to maintain the connection. U.S. Pat. No. 2,671,821 discloses a hanger system limited to hanging type fixtures.

Canadian patent No. 1,040,606 discloses an electrical coupling system which simultaneously provides for electrical contact of the fixture to the outlet box wiring, while securing the light fixture in place. The electrical outlet box is provided with a face plate which presents the electrical contacts in combination with lug portions. The light fixture includes mating lug portions which on rotation clip into and secure the light fixture in place on the face plate. The lug portions on the light fixture also include electrical contacts which lead to the lamp of the fixture. Hence when the lug portions are engaged to support the light fixture, the electrical contacts engage to complete the circuit. The drawback with this system is that, due to the inter-relationship of the lugs and the electrical contacts, there is a limitation on the amount of support that can be provided in the lug systems while continuing to provide suitable engagement of the electrical contacts. Furthermore, the electrical contacts are left exposed thereby presenting potential hazard in mounting the light fixture in place or allowing the user to reach up into the outlet of the face portion and contact one or more of the live electrical leads.

Canadian patent No. 1,040,606 also suffers from the disadvantage of the prior art U.S. patents in that it cannot be universally applied to connecting a wide variety of fixtures. For example, FIGS. 1 and 2 of the prior art Canadian patent illustrate that a central threaded tubular rod is mounted to the coupling as a central tubular rod connector. The threaded tubular rod is relatively short and is designed to hold the cover plate in position and to provide a thread to attach a ring (or hook) upon which a light fixture or chain is hung. The disclosure describes use of the ring (or hook) in terms which are specific to the application of hanging a light fixture or chain therefrom.

In summary, prior art coupling devices suffer from the disadvantages that they protrude significantly into the electrical junction box; they are of complex design; and installation of the fixtures is typically complex (i.e. requiring two or more steps).

SUMMARY OF THE INVENTION

An electrical coupling device for detachably securing a fixture to an electrical connector box in accordance with an aspect of the present invention comprises male and female interconnecting components. The fixture is connected to the male component where the male component is secured to the female component by rotating one component relative to the other. The female component has a plurality of catches. The male component has a plurality of studs for insertion and engagement with the catches by way of rotational movement of the studs into the catches. The catches are spaced apart in a circular array at a first radius relative to the center of rotation of the components. The improvement comprises:

(1) at least two spaced-apart female resilient clips of electrically conductive metal, the clips are located in a circular pattern at a second radius on the female component;

(2) the male component has at least two spaced-apart contacts of electrically conductive metal, the contacts being located in a circular pattern at the second radius;

(3) the male contacts are in register with the clips when the studs are in register with the catches.

Rotation of the male component to engage the studs with the catches simultaneously engages the contacts with the clips to depress the clips slightly to ensure electrical contact.

According to the present invention, an electrical coupling device is provided which does not significantly protrude into the electrical outlet box or ceiling as in the aforementioned prior art devices. The device of the present invention requires a simple rotation to attach and detach a light fixture that has an appropriate connector. The device is applicable to a wide range of light fixture types and electrical box sizes, and can be directly mounted to a building surface, without an electrical junction box, and without protrusion into the wall or ceiling.

BRIEF DESCRIPTION OF THE DRAWINGS

Preferred embodiments of the invention are shown in the drawings, wherein:

FIG. 3 is a section through the male and female components of the coupling prior to assembly;

FIG. 4 is a section through the assembled coupling;

FIG. 4A is a section view along the lines 4A—4A in FIG. 4;

FIG. 11 is an exploded sectional view of a hanging chain lamp fixture mounted according to a fifth alternative embodiment of the present invention.

DETAILED DESCRIPTION OF THE PREFERRED EMBODIMENTS

Figure 1:
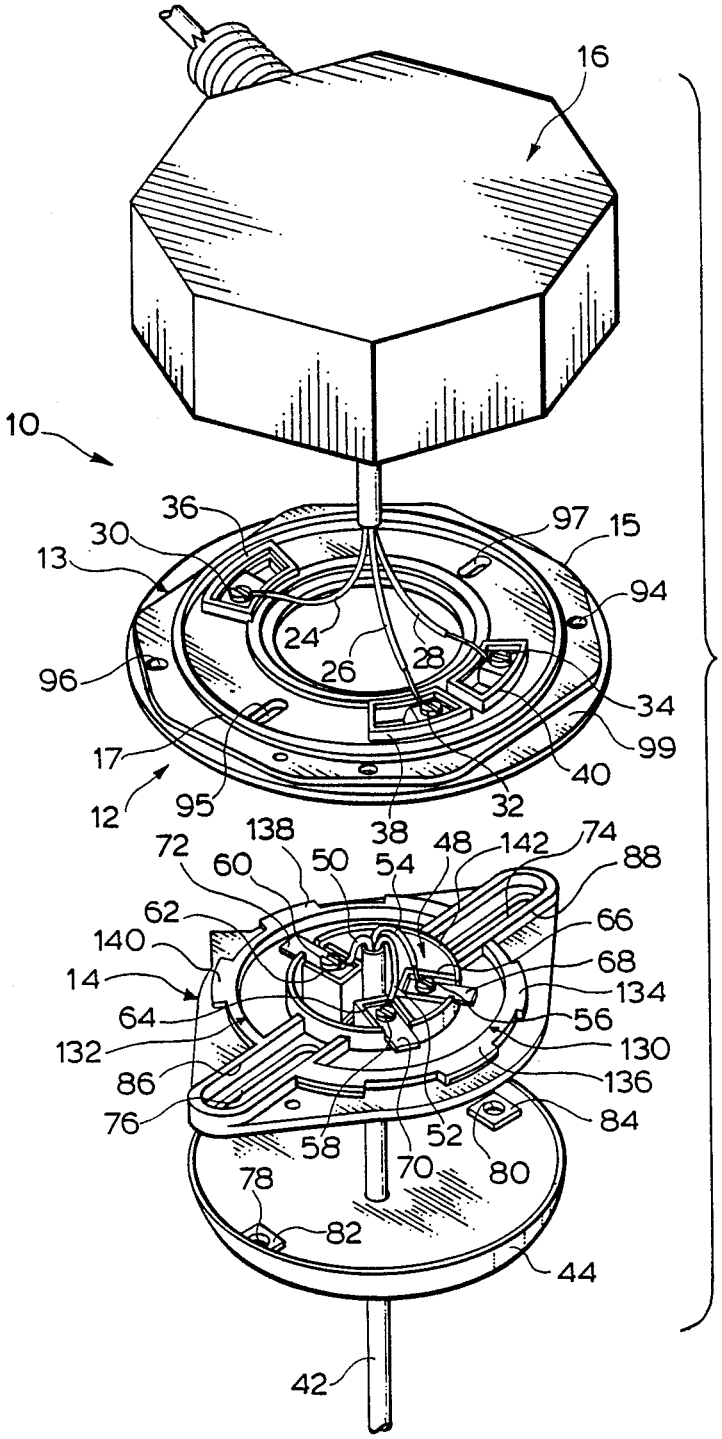
FIG. 1 is an exploded perspective view from above of the electrical fixture coupling according to an aspect of this invention.
Figure 2:
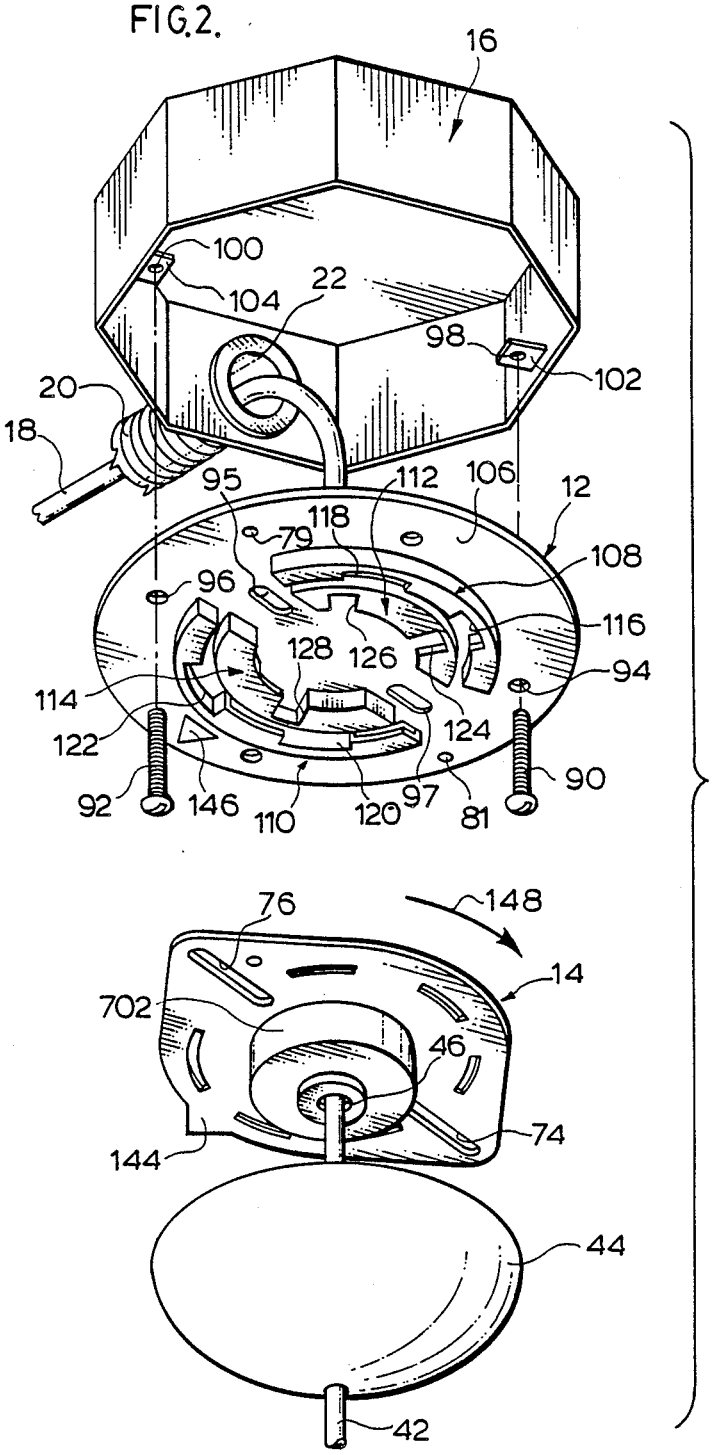
FIG. 2 is an exploded perspective view of the electrical fixture coupling of FIG. 1 from the underside.

It is appreciated that a variety of electrical outlet boxes and fixtures are available in the marketplace. For purposes of discussion of this invention and demonstration of its principles, specific reference will be made to a well known type of outlet box and fixture constructions. It is, of course, appreciated that the principles of the invention would, however, apply to any other type of readily available fixture and electrical outlet. With reference to FIGS. 1 and 2, the electrical fixture coupling device 10 comprises male and female components 14 and 12. The female component 12 is secured within or to a standard type of octagonal shaped electrical outlet box 16. Wiring 18 is fed through a cable shield 20 which may be of flex link metal and through the inlet coupling 22 of the outlet box 16. The three electrical leads 24, 26 and 28 of the standard 110 volt wiring system are coupled to the corresponding terminals 30, 32 and 34. In accordance with standard practice, two of the leads, for example 26 and 28, will be positive and negative leads, whereas lead 24 is the common ground. Each terminal 30, 32 and 34 is surrounded by a raised ridge portion 36, 38 and 40. The raised ridge serves to contain the looped end portion of the respective electrical wire lead and captured in place during connection of the leads to the terminals.

It is also possible to friction fit the contact terminals 30, 32 and 34 (see for example, FIG. 4A) and to have a self attaching connector in which electrical wires 24, 26 and 28 are pushed into a hole (not shown) in which electrical contact is made and the wires are secured. The preferred push connector of FIG. 4A is characterized by significant advantages over prior art push connectors common on existing switches and receptacles.

The male component 14 has an electrical wire 42 which is connected to a light fixture or the like extending through a decorative dished-shaped exterior plate 44 and through an aperture 46 of the male component 14 and into the chamber generally designated 48. There are three electrical wires of the incoming light fixture wire 42 which are designated 50, 52 and 54. The wires are respectively secured to the electrical terminals 56, 58 and 60. As with the terminals of the female component 12, the terminals 56, 58 and 60 are surrounded by a raised ridge portion 62, 64 and 66. This assists in assembly and connection of the electrical wires to the terminals to capture them in place. Each of the terminals 56, 58 and 60 include outwardly extending contacts 68, 70 and 72. These male contacts engage corresponding female contacts of the female component 12, as will be discussed with respect to FIGS. 2, 3 and 4.

The male component 14 includes elongate recesses 74 and 76 which receive nut and bolt combinations for connecting decorative plates, such as plate 44, and for securing the light fixture to the male component 14. For example, self tapping screws 8 or bolts may be extended through the elongate recesses 74 and 76 and threaded into apertures 78 and 80 of lugs 82 and 84 to secure the attachment plate 14 in position, as described in greater detail below with reference to FIGS. 5, 6 and 8. Each recess 74 and 76 is surrounded by a suitable ridge 86 and 88 to enclose the respective bolt head.

In order to prevent accidental dislodgement, a locking device is incorporated into the female component 12 in the form of small domed protrusions or dimples 79 and 81 which are designed to slide over the surfaces of winged recesses 74 and 76 of male component 14 when the male component 14 is being rotated clockwise relative to female component 12 for connecting the male and female components. However, the dimples 79 and 81 abut the winged recesses 74 and 76 when the male component is rotated into connection with the female component, thereby effectively preventing inadvertent counterclockwise rotation of the male component 14 relative to the female component 12 without the application of a reasonable amount of torque.

As shown in FIG. 2, the female component 12 is secured to the electrical outlet box 16 by use of bolts 90 and 92. The bolts extend through apertures 94 and 96 and are threaded into the threaded apertures 98 and 100 of the outlet box lugs 102 and 104. Alternatively, the bolts may extend through slotted apertures 95 and 97 for smaller sized electrical boxes. The secured position of the female component 12 in the electrical outlet box 16 is shown in FIG. 4. Provided on the upper surface 13 of the female component 12 is a ridge 15 which defines an octagonal shape which corresponds to the inner dimensions of a standard octagonal electrical outlet box 16. The raised ridge 15 correctly locates the base plate bolt holes 94 and 96 with the bolt holes 98 and 100 on the lugs 102 and 104 of the electrical box 16. This ensures a secure fitment of the female component 12 to position the component in the electrical outlet box 16. The circular disk, or flange 99, outside the octagon shaped ridge 15 extends beyond the dimensions of the electrical box and thereby ensures that the component 12 fits flush to a wall or ceiling even though the outlet box may be recessed or misaligned.

In some installations an electrical box is not required to house the electrical household wiring for the lamp fixture. In such cases, the female component 12 includes a further ridge 17 for providing clearance for the electrical wiring extending between the female component 12 and the ceiling. The overall dimensions of male component 14 and female component 12 can be reduced in such an installation.

The underside 106 of the female component 12 (FIG. 2), which constitutes the face plate of the electrical outlet box, includes two sets of semicircular ring portions generally designated 108, 110, 112 and 114. Ring set 108 and 110 include a plurality of catches, the entrance to which are defined by the respective recesses 116, 118, 120 and 122. The inner set of rings 112 and 114 include the female resilient clips of electrically conductive metal. The entrance to those clips is defined by recesses 124, 126 and 128. The clips are recessed so as to conceal live electrical parts.

The male component 14 includes on an outer ring set 130 and 132 the outwardly projecting stud portions 134, 136, 138 and 140. As already noted, on the inner ring portion, as defined by circular edge 142, outwardly extending male contacts 68, 70 and 72 are provided. The male component is provided with an integrally molded arrow 144 which, when aligned with the indented arrow 146 of the female component, automatically aligns the studs 134, 136, 138 and 140 with the recesses 116, 118, 120 and 122. Also, the electrical contacts 68, 70 and 72 are aligned with the recesses 124, 126 and 128.

To assemble the male component 14 to the female component 12 with the arrows 144 and 146 aligned, the male component 14 is rotated in the direction of arrow (clockwise) 148 to engage the studs with the catches. As shown in FIG. 3, the studs are defined by the lugs 136 and 138 which are of inverted L-shape to define undercut portions 150 and 152. The catches of the female component 12 are defined by the depending ledges 154 and 156 to define supporting surface 158 and 160. To support the male component, when engaged with the female component, the faces 150 and 152 rest on and are engaged with the faces 158 and 160 to support the light fixture in a manner to be discussed with respect to FIG. 4. The terminals 30 and 32 include resilient clips 162 and 164. As shown in the section of FIG. 4A, clips are J-shaped as protected by face portions 166 and 168 of the respective ring portion 112 and 114. The ledges 166 and 168 in covering the clips 162 and 164 prevent the user from engaging the clips with their fingers or various tools, such as screwdrivers, and hence substantially reduce the risk of electric shock during installation.

Figure 10A:
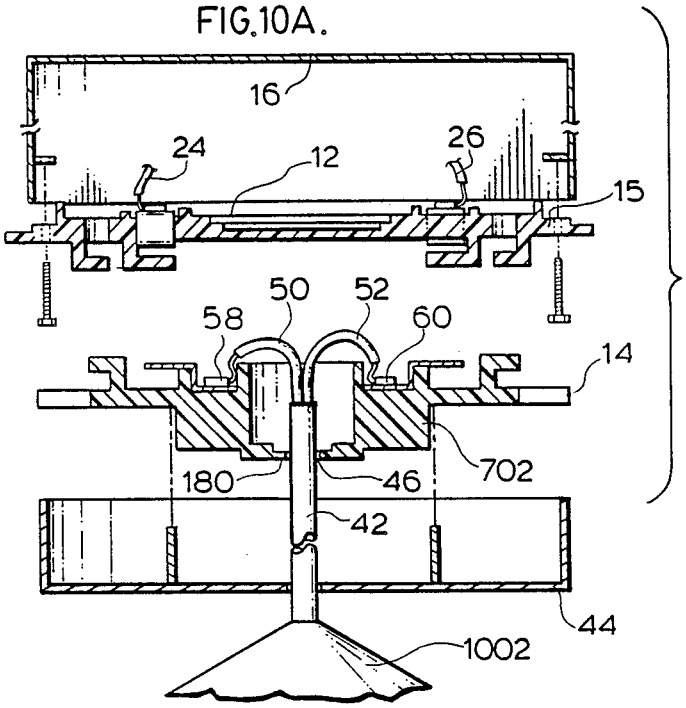
FIG. 10 is an exploded sectional view of a hanging cord lamp fixture mounted according to a fourth alternative embodiment of the present invention.

The J-shaped clips 162 and push connectors 163 are secured to the female component at the raised block portion 170 by way of the terminal screw or rivet 172. Hence a cantilever mounting of the J-shaped clip 162 is provided with a flexible distal portion 174. Multistrand wire may be inserted between clip 162 and push connector 163 which yields under bending pressure. The connector 163 then clamps down on the wire and secures the wire in place with a contact area extending fully around the arcuate portion of connector 163. The push connector arrangement of FIG. 4A may also be advantageously used for the terminals 58 and 32. When the male contact portion 72 abuts the sloping portion 174 during rotation of the male component relative to the female component, the distal portion 174 is pushed upwardly by the male contact 72 to ensure secure electrical contact between the male and female components. A similar action occurs with respect to the other electrical clips of the female component which occurs at the same time as the stud components of the male couplings 68 and 70 engage the associated catches of the female components (e.g. 162 and 164). As a result the assembled unit, as shown in FIG. 4, has the studs 134, 136, 138 and 140 engaged with the respective supporting ledges as exemplified in FIG. 4 as 154 and 156. The male contacts 70 and 72 engage the respective clips 162 and 164, thereby effecting a hanging cord lamp fixture connection as shown in FIGS. 10A and B. As discussed above, the electrical cord 42 is secured by means of a cord restrainer 1004. The restrainer effectively transfers the weight of the fixture to the flange 180 surrounding the aperture 46 of male component 14, and thereby to the female component 12 through the male component 14 via the support lugs 134, 136, 138 and 140 engaging the corresponding catches of the female component. No stress is applied to the electrical contacts 70 and 72. Hence the design of the lugs and catches of the male and female components is independent of the electrical contacts to thereby support any desired weight of the light fixture without interfering with the electrical contacts. In this way, the electrical contacts resiliently urge the clips upwardly to ensure continued electrical contact of the light fixture to the power source in incoming line 18.

Figure 5:
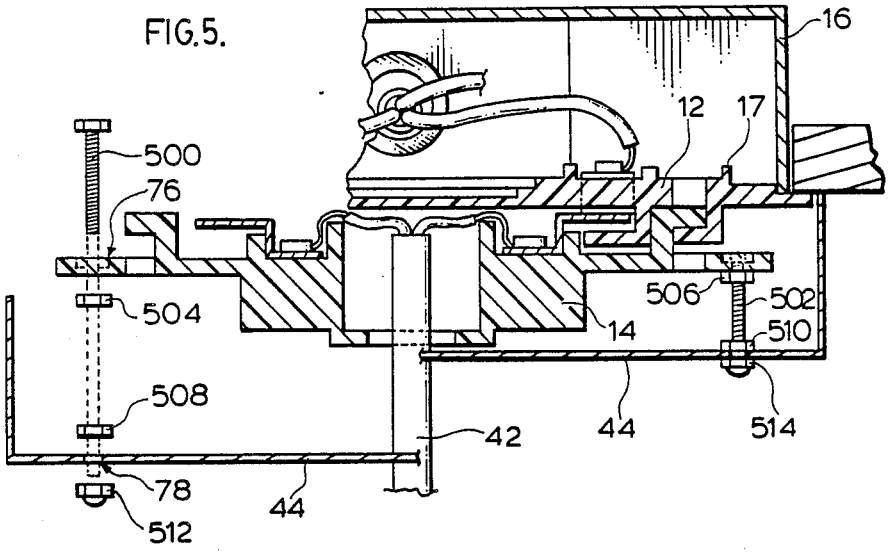
FIG. 5 is a combined half-section and exploded view of a bolt mounted fixture according to a first alternative embodiment of the present invention.
Figure 6:
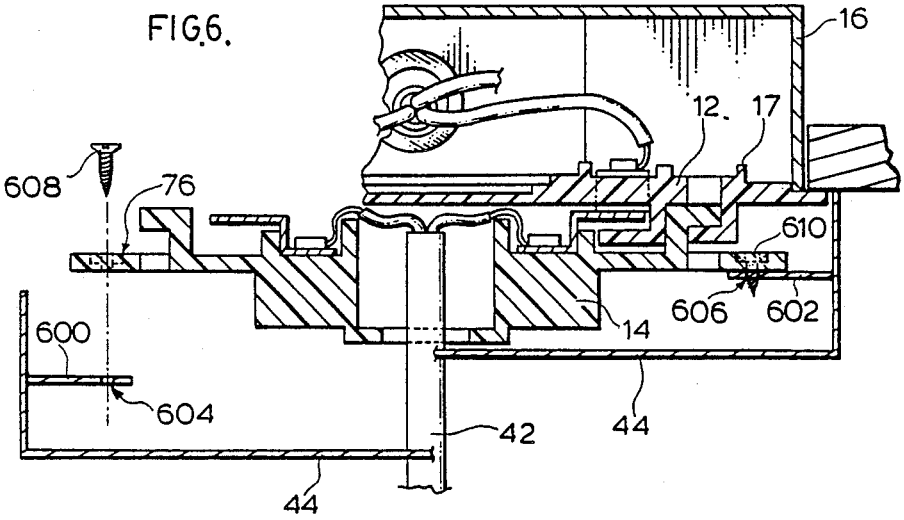
FIG. 6 is a combined half-section and exploded view of a modified bolt mounted fixture according to a second alternative embodiment of the present invention.

As shown in FIG. 4, the male component 14 has extending outwardly of the stud portions a plate extremity 182, 184 for supporting the two-bolt fixture of FIGS. 5 and 6 via apertures 74 and 76. As discussed above, when the unit is assembled, the female component 12 is flush against the face of the finishing material for the wall or ceiling to complete the assembly and provide a flush mount of the light fixture, and the cover plate 44 extends so as to cover the entire connector and fit flush with the wall or ceiling.

The male and female components of the coupling device are attached by means of the separate interengaging studs and catch portions. The system has been designed for close tolerances to achieve a secure and strong connection between the components. Once locked the components have a very low profile for preventing the female component 12 from intruding into the outlet box, and to ensure that the device remains inconspicuous when the male component 14 is not attached. The components of the device may be injection molded of suitable plastic resin. The plastic resin may include flame retardant, heat resistant, creep resistant additives. A suitable plastic may be that of acrylonitrile butadiene styrene composition.

Figure 9:
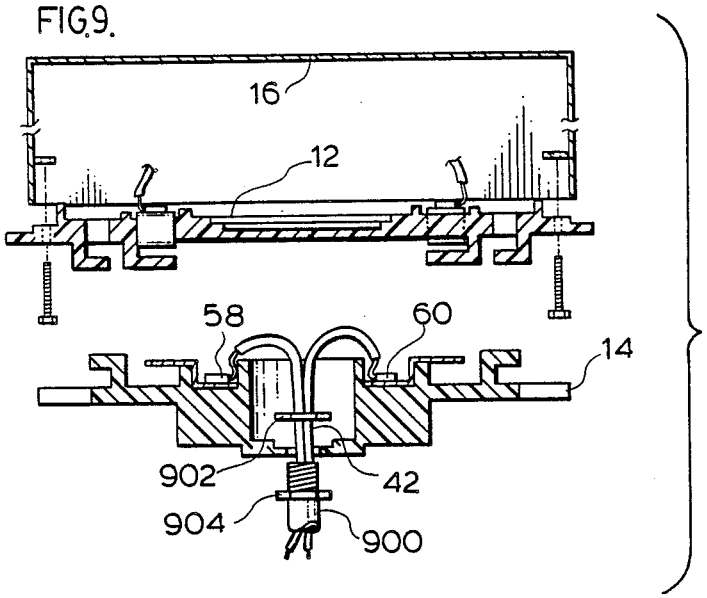
FIG. 9 is an exploded sectional view of a central tubular rod mounted fixture according to a third alternative embodiment of the present invention.

In addition to the light fixture mountings illustrated in FIGS. 1–4, additional mountings are contemplated within the terms of the present invention, as follows:

bolt mounted fixtures (FIGS. 5 and 6);
central tubular rod mounted fixtures (FIG. 9);
hanging cord lamp fixtures (FIG. 10);
hanging chain lamp fixtures (FIG. 11); and
integrally molded fixtures (not illustrated).

Turning to FIG. 5, a combined half-section and exploded view is provided of a bolt mounted fixture according to a first alternative embodiment mounted in the form of a retrofit. An ordinary two-bolt light fixture is mounted on the male component 14 by means of a pair of bolts 500 and 502 inserted through apertures 76 and 74, and secured by means of lock nuts 504 and 506, spacer nuts 508 and 510, and decorative nuts 512 and 514. The height of the cover plate 44 is determined by adjustment of spacer nuts 508 and 510. The bolts 500 and 502 are maintained in a correct width position within slots 74 and 76 by means of lock nuts 504 and 506. The cover plate 44 is secured to the bolts 500 and 502 by means of nuts 512 and 514, respectively.

A modified light fixture is illustrated with reference to FIG. 6. Manufacture installed mounting lugs 600 and 602 are provided with holes 604 and 606 through which a pair of self-taping screws 608 and 610 may be inserted, via holes 76 and 74 of the male component 14. The mounting lugs are installed at an appropriate height for correct positioning of the male component attachment plate 14 relative to the female component base plate 12.

Figure 7:
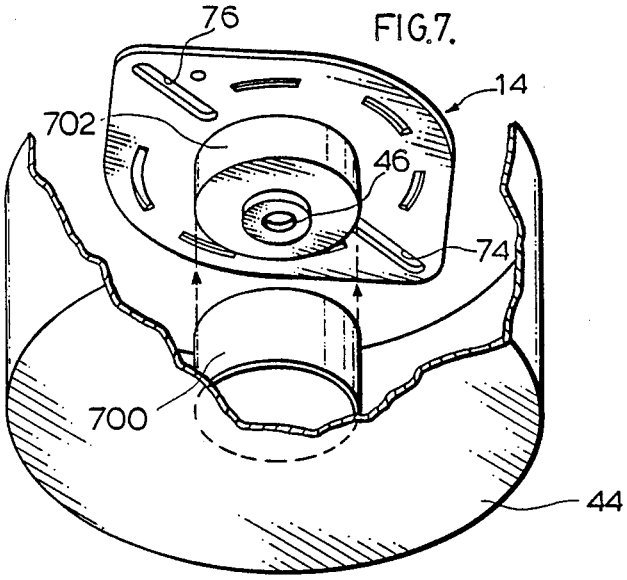
FIG. 7 is an exploded perspective view of a central tubular spacer ring for the bolt mounted fixture of FIGS. 5 and 6.
Figure 8:
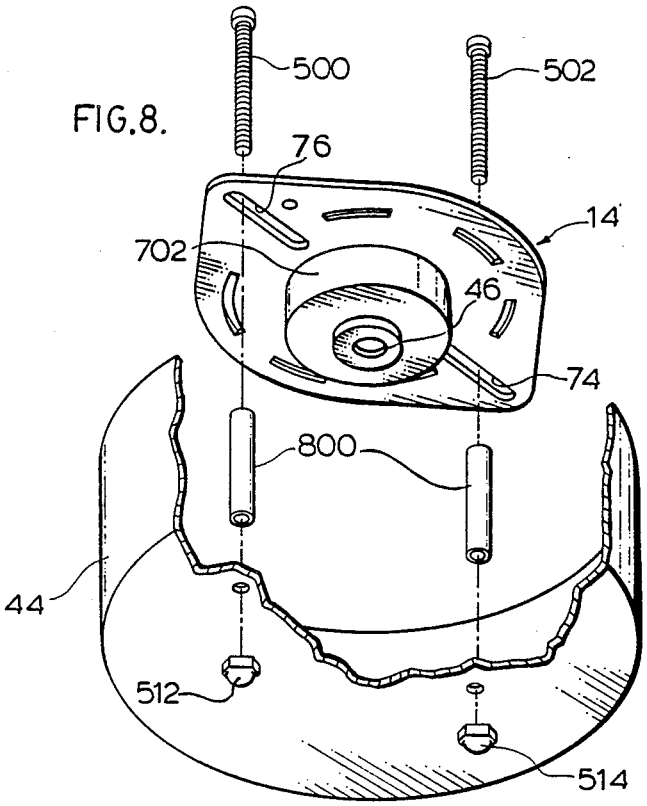
FIG. 8 is an exploded perspective view of tubular rod spacer rings for the bolt mounted fixtures of FIGS. 5 and 6.

Correct spacing between the male component 14 and the associated bolt mounted light fixture can also be realized by employing either central tubular spacer rings or tubular rod spacer rings as shown in FIGS. 7 and 8, respectively. According to FIG. 7, a central tube spacer ring 700 is mounted via a friction fit over the raised circular portion 702 of the male component 14. The spacer ring 700 can be constructed to various heights for achieving selective spacing of the cover plate 44 relative to the male component 14. FIG. 8 shows a pair of tubular rod spacers 800 which can be manufactured to predetermined heights to achieve selective spacing of the cover plate 44 relative to the male component 14. A pair of bolts 500 and 502 are inserted through the apertures 74, 76 of the component 14 and through the tubular rod spacers 800. A pair of decorative nuts 512 and 514 are fastened to the bolts 500 and 502 which protrude to respective apertures in the cover plate 44.

Traditional central tubular rod mounted fixtures are screwed into a cross bar that is bolted to the electrical outlet box. However, according to the embodiment of FIG. 9, the base plate or female component 12 is substituted for the cross bar of traditional installations, and the tubular rod 900 of the fixture is held in place by a pair of nuts 902 and 904 which lock the centrally mounted fixture in position. A cover plate (not shown) is then fastened to the central tubular rod 900 by means of a radially oriented screw, in a well known manner. The electrical wiring 42 runs through the tubular rod 900 and is connected to the attachment plate or male component 14 by means of electrical connector bolts or screws 56, 58 and 60 (FIG. 1). A cover plate 44 (FIG. 1 and 2) is attached to the central tubular rod 900 in the traditional fashion FIG. 10A illustrates a hanging cord fixture embodiment of the present invention in which a flexible electrical cord 42 extends from a lamp shade 1002 through an aperture 46 in the male component 14 which is held in place with a cord restrainer 1004 shown in detail with reference to FIG. 10B. The cord restrainer 1004 slides along the electrical cord 42 for adjusting the height of the lamp and the length of wiring which extends to the electrical contacts on the male component 14. The cord restrainer 1004 fits into and is compressed by the aperture 46 which restrains movement of the cord. A cover plate 44 is shown in FIG. 10A attached via a friction fit over the raised circular portion 702 of the male component 14.

FIG. 11 shows a hanging chain fixture according to another alternative embodiment of the present invention, wherein chain links 1100 are supported by a hook 1102 having a central threaded aperture for receiving a threaded tubular rod 1104. A pair of lock nuts 1106 connect the tubular rod 1104 to the male component 14. The hook 1102 is threaded onto the tubular rod 1104 for supporting the fixture connected at a remote end of chain 1100 and to hold the cover plate 44 to the building surface. The electrical cords 50 and 52 twine through the chain links 1100 in a well known manner.

Additionally, the attachment plate or male component 14 may be directly injection molded with a lamp fixture base to produce an integral unit (not shown). In such a case, only the central portion of the male component 14 is utilized. The elongated recesses 74 and 76 would not be used. Also, the electrical cord 46 is substituted with a direct electrical connection from the contacts 68, 70, 72 to the light bulb socket or sockets.

Although preferred embodiments of the invention have been described herein in detail, it will be understood by those skilled in the art that variations may be made thereto without departing from the spirit of the invention or the scope of the appended claims.

We claim:

1. An electrical coupling device for detachably securing a fixture to an electrical junction box, said coupling device comprising male and female interconnecting components, said fixture being connected to said female component when said male component is secured to said female component by rotating one component relative to the other, said female component having a plurality of catches, said male component having a plurality of studs for insertion and engagement with said catches by way of rotational movement of said studs into said catches, said catches and studs being spaced apart in circular arrays at a first radius, the improvement comprising:

(1) at least two spaced-apart female resilient clips of electrically conductive metal, said clips being in a circular pattern at a second radius on said female component;

(2) said male component having at least two spaced-apart contacts of electrically conductive metal, said contacts being located in a circular pattern at said second radius;

(3) said male contacts being in register with said clips when said studs are in register with said catches, rotation of said male component to engage said studs with said catches simultaneously engages said contacts with said clips to depress said clips slightly to ensure electrical contact.

2. An electrical coupling device of claim 1, wherein said clips are located in an unsymmetrical array about said circular pattern to ensure polarity matching of said corresponding contacts with said clips.

3. An electrical coupling device of claim 2, wherein each of said clips is a generally J-shaped metal clip which is compressible, said contacts depressing said clips to maintain electrical contact.

4. An electrical coupling device of claim 1, wherein there are three spaced-apart said female clips and three spaced-apart said male contacts.

5. An electrical fixture coupling device for detachably securing an electrical fixture to a building surface where electrical junction boxes are located, the device having a female component which is adapted to be connected to an electrical junction box and there maintain substantially flush contact with the building surface, and the complementary male component to which the electrical fixture is attached, said male component being releasably coupled to said female component to provide electrical and load-bearing connection to the electrical fixture, the female component comprising:

(i) a base plate having an inner junction box side and an outer wall surface side., (ii) attachment means cooperating with said base plate adapted to provide connection to junction boxes of various sizes and standards;

(iii) a plurality of circumferentially spaced female supporting means extending outwardly from the wall surface side of the attachment plate, said supporting means having circumferentially extending female lugs;

(iv) three circumferentially spaced female contacting means extending outwardly from the building surface side of the attachment plate, said three circumferentially spaced female contacting means being separated by three respective recesses, said contacting means located on a different radius from said supporting means to avoid interference with said supporting means, each said contacting means having an electrically conducting, resilient contact member adapted to be connected to an appropriate conductor, the male component comprising:

(v) an attachment plate with an inner surface adapted to releasably engage said female assembly of the base plate and having means to permit electrical connection from electrical conductors extending from the electrical fixture to electrical connectors on the attachment plate, an opposite outer surface of the attachment plate adapted for variable connection to the electrical fixture and serving as a building surface side;

(vi) a plurality of circumferentially spaced male supporting means extending upwards from the inner surface of the attachment plate, each male supporting means having a circumferentially extending male lug having engagement means complementary to their respective engagement means of the female lug, each lug being adapted to be accepted into a gap between the female lug and the base plate surface from which it extends, and (vii) three circumferentially spaced male contacting means extending upwards from the inner surface of the attachment plate having engagement means complementary to the respective engagement means of the appropriate female contacts, so that when the lugs and the contacts of the male component are moved into relative position to the gaps and recesses of the female component and the male component is rotated relative to the female component, the engagement means of each female supporting means engages the complementary engagement means of the male supporting means thereby providing a load bearing support and restricting rotation between the male and female components to substantially prevent accidental disengagement of the components, contemporaneously the male contacts frictionally engage the female contacts and thereby conduct electricity to the electrical fixture.

6. An electrical fixture coupling device as claimed in claim 5, wherein the junction box side of the female component has an octagonal ridge extending from its surface to frictionally engage a common octagonal junction box, said octagonal ridge is contained within a circular outer edge of said female component, said outer edge to flush mount the base plate where the junction box is recessed in the building surface.

7. An electrical fixture coupling device as claimed in claim 5, wherein six said female and male supporting means are circumferentially spaced so that each male and female combination transfers a substantially equal load.

8. An electrical fixture coupling device as claimed in claim 5, with features to ensure correct alignment of the male and female components and therefore polarity of the electrical connectors as follows:

(i) an arrow molded into the electrical fixture side of the base plate is aligned with a protrusion of the male component before rotational engagement;

(ii) the three circumferentially spaced female contacting means and corresponding male contacting means are so spaced to ensure that there is only one position for engagement.

9. An electrical fixture coupling device as claimed in claim 5, wherein said male component has two long slots which allow it to be mounted to a variety of light fixtures utilizing a pair of screws in a two point hanging system, said slots being recessed from the mounting surface to accommodate the screws, said male component also has a central hole to accommodate one point mounted fixtures with a hexagonal profile molded into the attachment plate to aid and secure attachment of the fixture to the attachment plate via one hexagonal nut.

10. An electrical fixture coupling device as claimed in claim 5, wherein said live electrical contacts in the female component are so recessed within the base plate to substantially eliminate the possibility of accidental contact.

11. An electrical fixture coupling device as claimed in claim 7, wherein said attachment plate is deep so as to provide room for attaching centrally mounted light fixtures, as well as to provide room for wiring.

12. An electrical fixture coupling device as claimed in claim 5, wherein said base plate and attachment plate have a raised border where the terminals are to be connected to ensure proper positioning of the electrical contacts, as well as to retain electrical wires.

13. An electrical fixture coupling device as claimed in claim 5, wherein said attachment plate further includes a pair of apertures for receiving a pair of threaded bolts to which a cover plate of said electrical fixture is attached via one or more nuts.

14. An electrical fixture coupling device as claimed in claim 5, wherein said attachment plate further includes a pair of apertures for receiving a pair of self-tapping screws by which a cover plate of said electrical fixture is connected to said attachment plate.

15. An electrical fixture coupling device as claimed in claim 5, further including a spacer ring attached via friction fit to said attachment plate for effecting a predetermined spacing between said attachment plate and a cover plate of said electrical fixture.

16. An electrical fixture coupling device as claimed in claim 5, further including a pair of tubular rod spacers, a pair of corresponding bolts extending through apertures within said attachment plate and further apertures within a cover plate of said electrical fixture, and a pair of decorative nuts for threadably securing said cover plate to said attachment plate, said tubular rod spacers being provided for effecting a predetermined spacing between said attachment plate and cover plate.

17. An electrical fixture coupling device as claimed in claim 5, wherein said electrical fixture includes a threaded tubular rod for insertion through an aperture within said attachment plate, and a pair of lock nuts being provided for threadably securing said tubular rod to a flange extending around said aperture within said attachment plate.

18. An electrical fixture coupling device as claimed in claim 5, wherein said attachment plate is provided with an aperture through which an electrical cord extends from said electrical fixture, said electrical cord being provided with a cord restrainer for gripping and thereby restraining said electrical cord within said aperture of said attachment plate.

19. An electrical fixture coupling device as claimed in claim 5, wherein said electrical fixture is further provided with a chain and a threaded hook portion for supporting said chain, a threaded tubular rod for insertion within an aperture of said attachment plate, and a pair of lock nuts for securing said threaded tubular rod to said attachment plate, and said hook portion being threadably secured to said threaded tubular rod for securing said electrical fixture to said attachment fixture.

* * * * *